US010870026B2

(12) United States Patent
Frasure et al.

(10) Patent No.: US 10,870,026 B2
(45) Date of Patent: Dec. 22, 2020

(54) SPRING-COLLET MECHANISM FOR ACTIVATING A FIRE EXTINGUISHER

(71) Applicant: Kidde Technologies, Inc., Wilson, NC (US)

(72) Inventors: David Frasure, Wilson, NC (US); John Wright Porterfield, Raleigh, NC (US)

(73) Assignee: Kidde Technologies, Inc., Wilson, NC (US)

( * ) Notice: Subject to any disclaimer, the term of this patent is extended or adjusted under 35 U.S.C. 154(b) by 0 days.

(21) Appl. No.: 15/829,285

(22) Filed: Dec. 1, 2017

(65) Prior Publication Data

US 2018/0085612 A1 Mar. 29, 2018

Related U.S. Application Data

(62) Division of application No. 14/602,811, filed on Jan. 22, 2015, now Pat. No. 9,861,846.

(51) Int. Cl.

| | |
|---|---|
| ***A62C 13/62*** | (2006.01) |
| ***A62C 13/70*** | (2006.01) |
| ***A62C 13/74*** | (2006.01) |
| ***A62C 35/02*** | (2006.01) |
| ***A62C 35/11*** | (2006.01) |
| ***A62C 37/36*** | (2006.01) |
| *A62C 3/08* | (2006.01) |

(52) U.S. Cl.

CPC ..... *A62C 13/62* (2013.01); *A62C 13/70* (2013.01); *A62C 13/74* (2013.01); *A62C 35/023* (2013.01); *A62C 35/11* (2013.01); *A62C 37/04* (2013.01); *A62C 37/36* (2013.01); *A62C 3/08* (2013.01)

(58) Field of Classification Search

CPC ..... A62C 13/62; A62C 37/04; A62C 37/36; A62C 35/11; A62C 35/023; A62C 13/74; A62C 3/08; A62C 13/70

USPC .... 169/9, 30, 71, 26, 29, 85, 88, 74, 76, 77, 169/35; 137/67, 68.11, 68.19, 68.29, 68.3

See application file for complete search history.

(56) References Cited

U.S. PATENT DOCUMENTS 2,441,011 A 5/1949 Dodelin
3,387,662 A * 6/1968 Molgano, Jr. ..... A62C 31/00 169/26

(Continued)

FOREIGN PATENT DOCUMENTS

CN 200939162 8/2007
CN 201253436 6/2009

(Continued)

OTHER PUBLICATIONS

Extended European Search Report dated Jun. 17, 2016 in European Application No. 16152040.8.

(Continued)

*Primary Examiner* — Qingzhang Zhou
(74) *Attorney, Agent, or Firm* — Snell & Wilmer L.L.P.

(57) ABSTRACT

A method of actuating an extinguisher system may comprise retaining a broadhead cutter in close proximity to a burst disc surface, receiving an impulse signal, actuating a spring release mechanism in response to receiving the impulse signal, driving a cutter shaft towards the burst disc surface in response to actuation, and piercing the burst disc surface via the broadhead cutter coupled to the cutter shaft.

5 Claims, 9 Drawing Sheets

(56) References Cited

U.S. PATENT DOCUMENTS

| | | | | |
|---|---|---|---|---|
| 4,356,936 | A * | 11/1982 | Legris | B63C 9/24 222/5 |
| 5,010,911 | A | 4/1991 | Grant | |
| 5,230,531 | A * | 7/1993 | Hamilton | B60R 21/272 222/5 |
| 6,164,383 | A | 12/2000 | Orrett | |
| 6,991,005 | B2 * | 1/2006 | Fedeli | A45C 13/24 141/114 |
| 9,144,699 | B1 | 9/2015 | Wang | |
| 2005/0011552 | A1 | 1/2005 | Sundholm | |
| 2009/0173506 | A1 | 7/2009 | Yoshida | |
| 2010/0132967 | A1 | 6/2010 | Yoshida | |
| 2012/0043096 | A1 | 2/2012 | Butz | |
| 2013/0014964 | A1 | 1/2013 | Yoshida | |
| 2013/0098639 | A1 | 4/2013 | Dunster | |
| 2014/0020791 | A1 * | 1/2014 | Anderson | B63C 9/24 141/114 |
| 2015/0107685 | A1 | 4/2015 | Porterfield | |

FOREIGN PATENT DOCUMENTS

| | | |
|---|---|---|
| CN | 102224365 | 10/2011 |
| CN | 203421247 | 2/2014 |
| EP | 2965786 | 1/2016 |
| GB | 489485 | 7/1938 |
| GB | 2048062 | 12/1980 |
| WO | 2010059282 | 5/2010 |

OTHER PUBLICATIONS

Chinese Intellectual Proerty Office of People's Republic of China, Chinese Office Action dated Aug. 22, 2019 in Application No. 201610045381.4.

Chinese Intellectual Proerty Office of People's Republic of China, Chinese Search Report dated Aug. 7, 2019 in Application No. 201610045381.4.

* cited by examiner

PRIOR
ART

SPRING-COLLET MECHANISM FOR ACTIVATING A FIRE EXTINGUISHER

CROSS REFERENCE TO RELATED APPLICATIONS

This application is a divisional of, and claims priority to, and the benefit of U.S. patent application Ser. No. 14/602,811, filed on Jan. 22, 2015, and entitled "SPRING-COLLET MECHANISM FOR ACTIVATING A FIRE EXTINGUISHER" which is incorporated by reference herein in its entirety.

FIELD

The present disclosure relates to fire extinguisher systems and their components.

BACKGROUND

Today's modern aircraft use hermetically sealed fire extinguishers that are opened, or activated, by direct explosive impingement energy. With reference to Prior Art FIG. 1, the device which provides the explosive energy is typically called a cartridge 120, or squib. The impingement energy is focused on a dome-shaped hermetic burst disc 110 such that the burst disc will rupture as a result of the impingement. The burst disc material used is typically fabricated from corrosion resistant steel.

Typically, the cartridge 120 is retained in a discharge head 130 in such a manner that it directly faces the burst disc 110 assembly. The discharge head 130 is attached to the outlet of the fire extinguisher and is typically used to direct the flow of extinguishing agent to an aircraft interface, such as plumbing or tubing, which directs the agent to the desired location. A filter screen 150 is located within the discharge head to catch any large burst disc fragments created as a result of the explosive impingement energy.

SUMMARY

The present disclosure relates to fire extinguisher systems and their components. According to various embodiments, a fire extinguisher system comprising a broadhead cutter configured to pierce a burst disc, a broadhead cutter shaft coupled to the broadhead cutter, a spring system coupled to a broadhead cutter shaft, and a spring releasing mechanism coupled to the spring system are described herein. The spring releasing mechanism may be electrically activated. A collect may be configured to retain the spring system in a non-actuated position. A pull rod may be configured to retain the collect in a standby position. A stop ring may be configured to retain the broadhead cutter shaft within a discharge head. The broadhead cutter is configured to pierce the burst disc in response to actuation of the spring system. The fire extinguisher system may be pyrotechnic free. The burst disc may be configured to petal out in response to piercing by the broadhead cutter. The pressure and extinguishing agent being expelled from within the fire extinguisher may aid in opening of petals of the burst disc.

According to various embodiments, a method of actuating an extinguisher system is described herein. The method may include retaining a broadhead cutter in close proximity to a burst disc surface. The method may include receiving an impulse signal. The method may include actuating a spring release mechanism in response to receiving the impulse signal. The method may include driving a cutter shaft towards the burst disc surface in response to actuation. The method may include piercing the burst disc via a broadhead cutter coupled to the cutter shaft. A collect may be configured to retain the spring release mechanism in a standby position. The spring release mechanism may be actuated by an electrical actuation signal. Travel of the cutter shaft may be stopped via physical contact with a stop ring. The pressure and extinguishing agent being expelled from within the fire extinguisher aid in opening of petals of the burst disc. The burst disc is configured to petal out in response to piercing by the broadhead cutter.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

Figure 1:
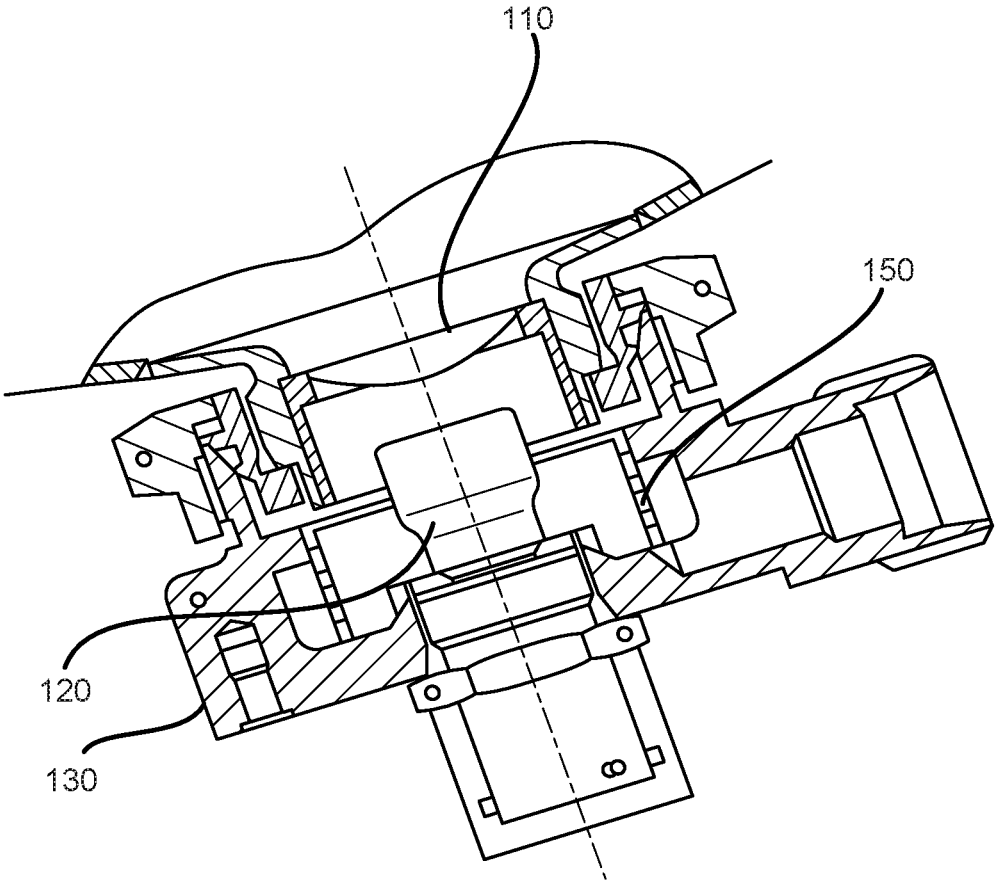
FIG. 1 depicts a prior art fire extinguisher system.

The detailed description of exemplary embodiments herein makes reference to the accompanying drawings, which show exemplary embodiments by way of illustration and their best mode. While these exemplary embodiments are described in sufficient detail to enable those skilled in the art to practice the disclosure, it should be understood that other embodiments may be realized and that logical changes may be made without departing from the spirit and scope of the disclosure. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step.

The present disclosure relates to fire extinguisher systems and their components. According to various embodiments and with reference to FIG. 2, a burst disc assembly 210 is ruptured from inside the fire extinguisher. In contrast to traditional systems, the explosive cartridge is replaced by a broadhead cutter 260 attached to an actuator. The actuator may be any desired actuator. For instance, the actuator may be a cutter shaft 250 which will be put in motion by the release of the elastic potential energy of a spring system 220.

A discharge head 320 (with brief reference to FIG. 3) may be used for interfacing to the aircraft plumbing/tubing to direct the agent to the desired location. A debris screen is not utilized in the discharge head 320 because the broadhead cutter 260 does not produce fragments when the fire extinguisher outlet burst disc assembly 210 is ruptured.

Figure 2:
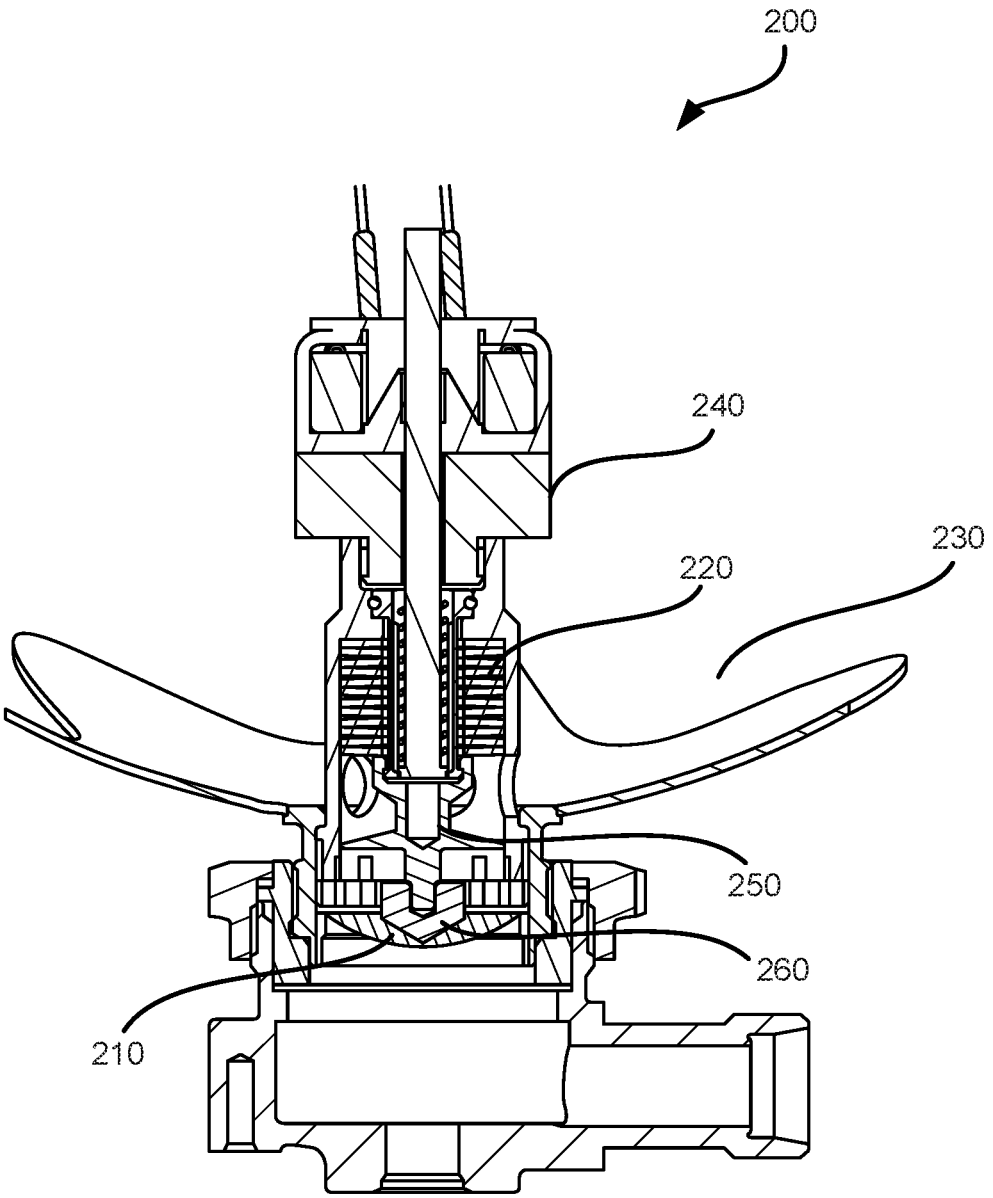
FIG. 2 depicts an advanced fire extinguisher system in accordance with various embodiments.

FIG. 2 illustrates a broadhead cutter 260 activation mechanism and system 200 inside of a fire extinguisher in accordance with various embodiments. Fire extinguisher system 200 may be pyrotechnic free. The fire extinguisher may comprise an internal volume area 230. Fire extinguishers can range in size 40 cubic inches to 2500+ cubic inches. The fire extinguisher may comprise a burst disc assembly 210. The burst disc assembly 210 may be made from any suitable material configured to be pierced by the broadhead cutter 260. The broadhead cutter 260 device may be attached to a cutter shaft 250 which is driven downward (towards the center of the burst disc assembly 210) in response to the elastic potential energy being released from the spring system 220. The spring system 220 releasing mechanism 240 may be, for example, a solenoid, a motor, such as a DC motor, a DC geared motor, a linear motor, a rotational solenoid using a ratcheted drive mechanism, and/or the like.

It should be noted that any structure located inside of the fire extinguisher associated with the support/stabilization of the mechanisms described below, as well as the routing of the electrical connections from the electrical connector 310, with brief reference to FIG. 3, to the spring system 220 releasing mechanism 240 are not shown in order to simplify the drawings.

Figure 3:
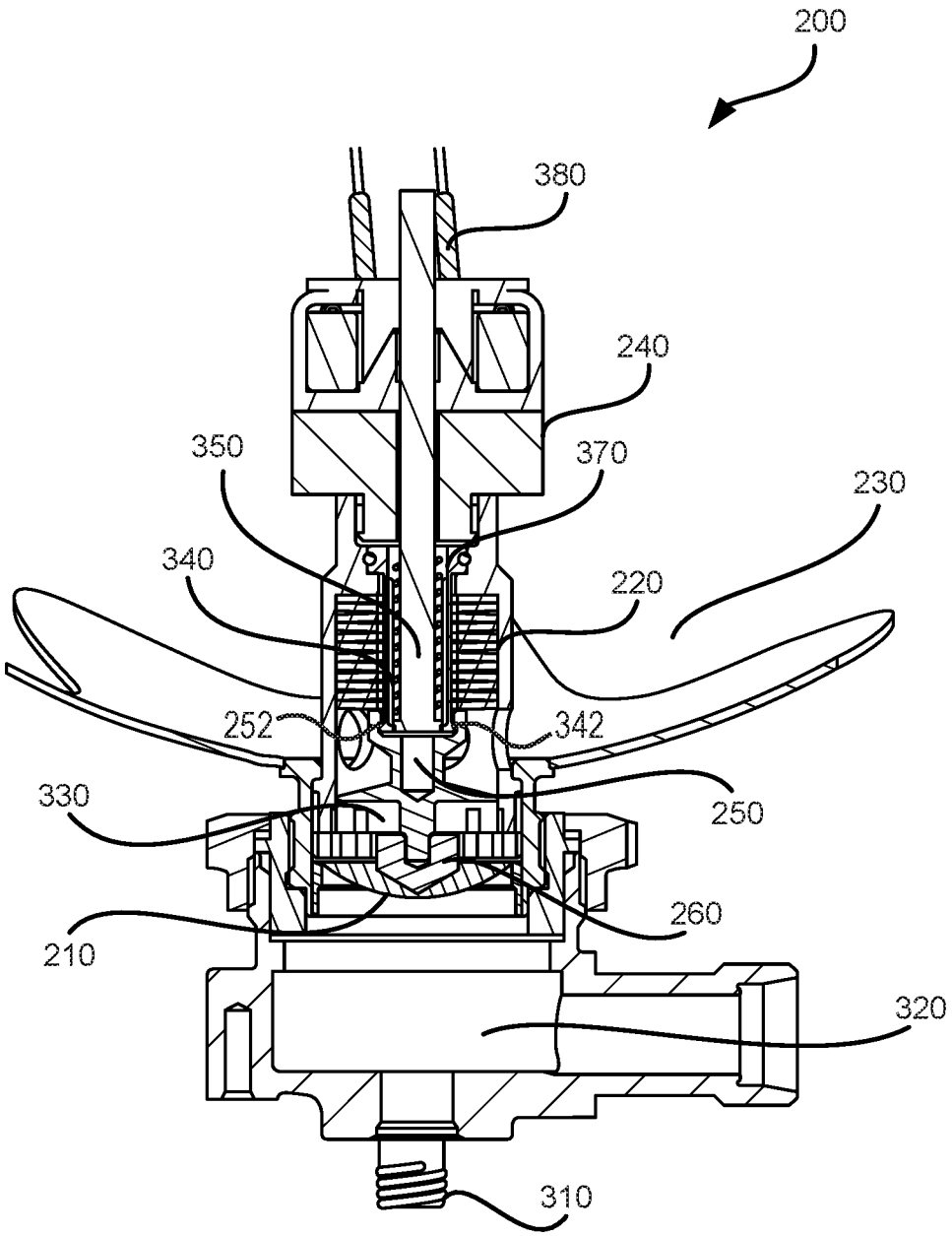
FIG. 3 depicts an advanced fire extinguisher system and its components in accordance with various embodiments.

According to various embodiments and with reference to FIG. 3, a pull rod 350 (aka a lock pin) is used to hold the collet 340 in a closed (forced outward) position to keep the spring system 220 compressed. The collet 340 is pushed outward so its outer flange 342 engages a recess 252 within the cutter shaft 250, so it is retained and cannot be moved downward (towards the discharge head 320 by the compressed spring system 220. Therefore, the spring system 220 is held in a compressed state by a portion of the cutter shaft 250. The spring system 220 can be any type of a spring system, such as Bellville washers, helical/coil spring, and/or the like.

According to various embodiments and with continued reference to FIG. 3, a lock pin spring 370 may be used to apply a positive pressure on the pull rod 350 so the pull rod 350 maintains the collet 340 in a closed (force outward) position. The lock pin spring 370 is utilized so the pull rod 350 is retained in its normal position during periods of shock and vibration.

Figure 4A:
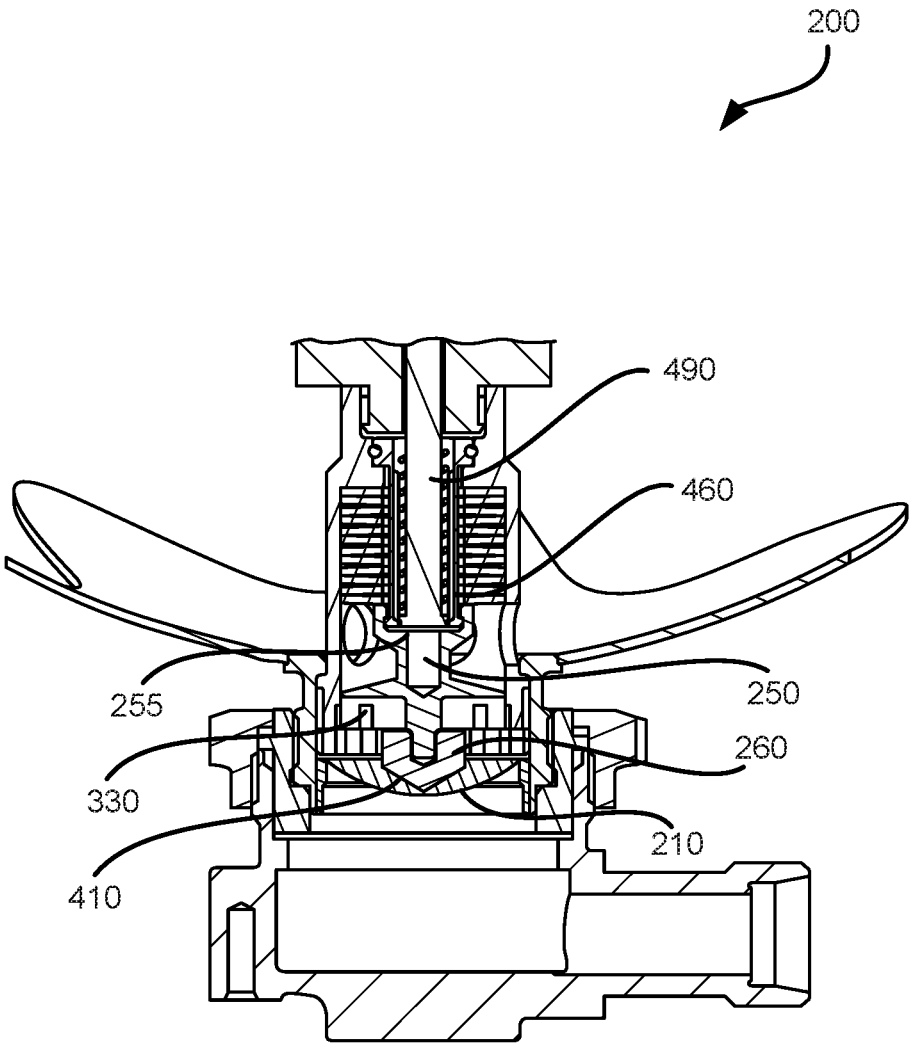
FIGS. 4A, 4B and 4C depict a fire extinguisher which is activated upon command by releasing the elastic potential energy of a spring system to drive a broadhead cutter configured to rupture a hermetic burst disc in accordance with various embodiments.

According to various embodiments and with reference to FIG. 4A, in a standby mode, the spring system 220 is held in compression by a face 255 of the cutter shaft 250. In the standby mode the broadhead cutter 260 is in a first position 410 in proximity to but not in contact with the burst disc assembly 210. The outer flange of the collet 340 retains the cutter shaft 250 in a retaining position 460. The pull rod 350 may be in a normal position 490 in standby mode holding the collet 340 in a forced outward position. Should the extinguisher be activated, an electrical impulse may be sent via an electrical connection 380 to the spring system release mechanism 240 (as depicted in FIG. 2 and FIG. 3). Spring system release mechanism 240 pulls the pull rod 350 upward from its normal position in standby mode holding the collet 340 in a forced outward position.

Figure 4B:
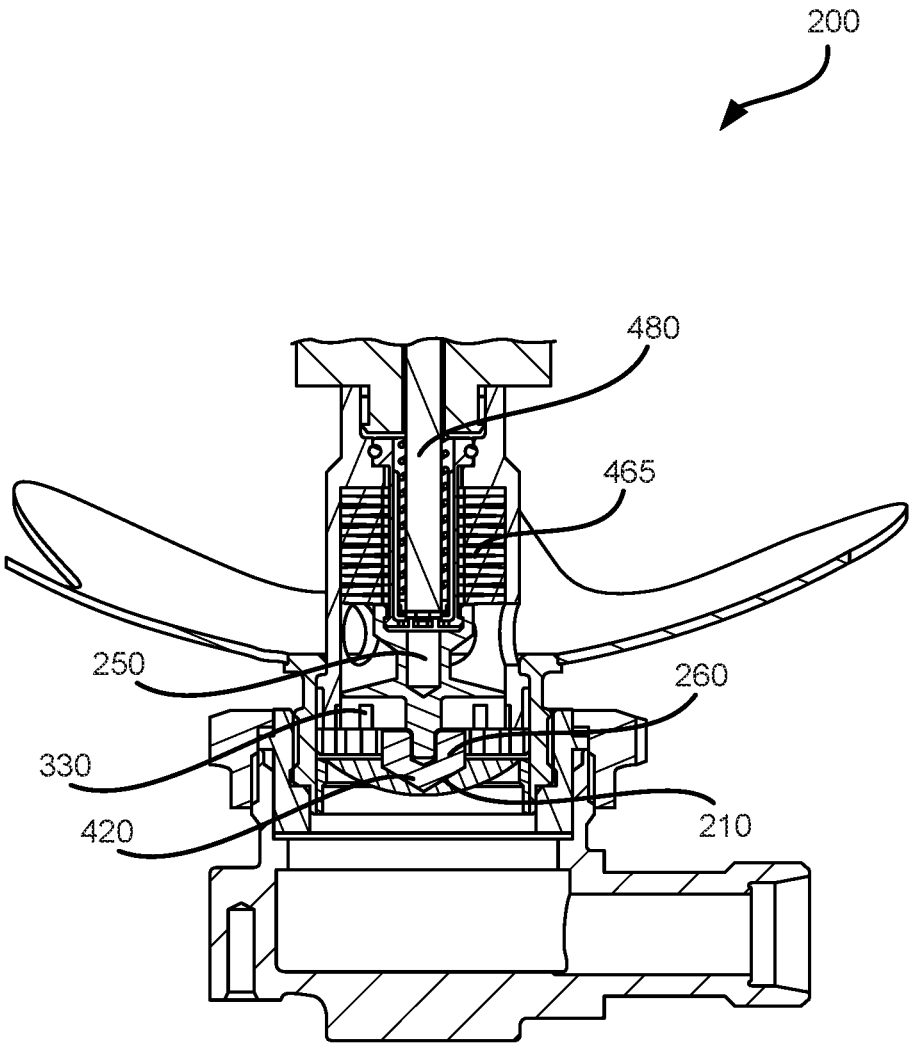

According to various embodiments and with reference to FIG. 4B, in response to the pull rod 350 being pulled upward, as described above, an outer flange of the collet 340 is no longer being held in place against the recess in the cutter shaft 250, so the force of the spring system 220 on the cutter shaft 250 is now free and/or available to push the cutter shaft 250 downward as the collet 340 fingers flex radially inward with respect to collet 340. The spring system may be in a flex position 465. As the cutter shaft 250 moves downward to a downward position 480, the broadhead cutter 260 pierces the burst disc assembly 210. In this way, the broadhead cutter 260 is in a piercing position 420. The downward movement of the cutter shaft 250 and/or broadhead cutter 260 is stopped by the stop ring 330.

Figure 4C:
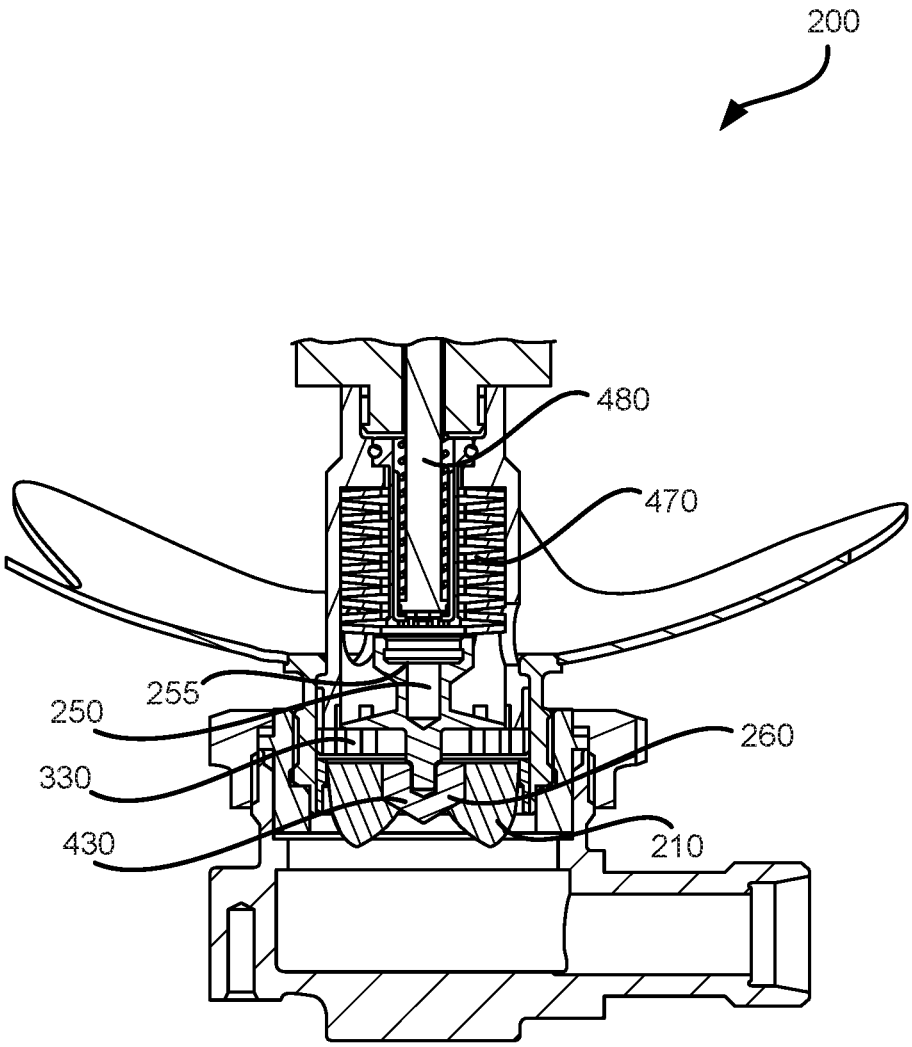

According to various embodiments and with reference to FIG. 4C, in response to the broadhead cutter 260 penetrating the burst disc assembly 210, the pressure and extinguishing agent being expelled from within the fire extinguisher aid in the opening of the petals of the burst disc assembly 210 started by the broadhead cutter 260. Stated another way the burst disc assembly 210 may petal out and split into a plurality of petal like shapes, such as four petals, when pierced by the broadhead cutter 260. Moreover, the spring system 220 is in substantially fully activated and/or extended position 470. In this way, broadhead cutter 260 is in a second position 430 where the burst disc assembly 210 is at least substantially opened by the pressure and extinguishing agent within the fire extinguisher. FIG. 4C also illustrates that that the cutter shaft 250 in its fully extended downward position 480 has been stopped and retained by the stop ring 330 to keep the broadhead cutter 260 from becoming a projectile. The broadhead cutter 260 starts the formation of the four petals, and the high pressure within the fire extinguisher completes the opening of the four petals to a substantially fully open position. The number of petals is related to the shape and design of the broadhead cutter 260.

Figure 5A:
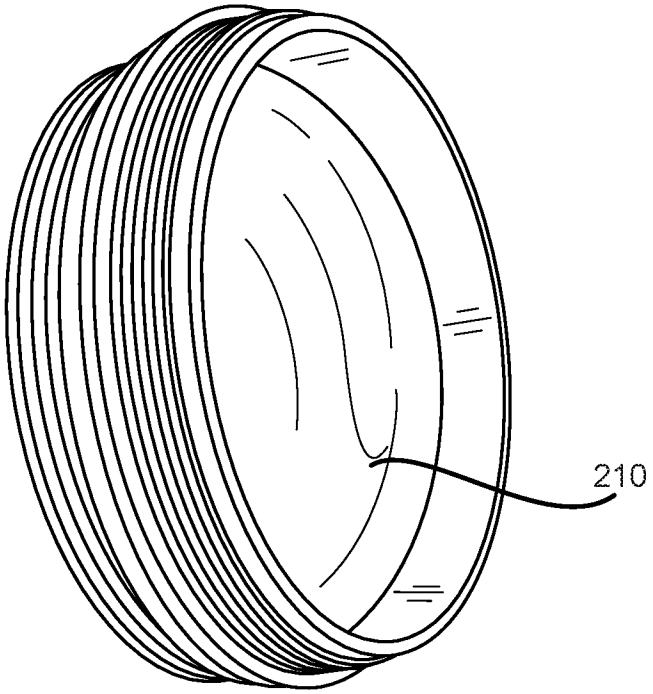
FIGS. 5A and 5B depict a whole burst disc and a pierced burst disc, respectively, in accordance with various embodiments.
Figure 5B:
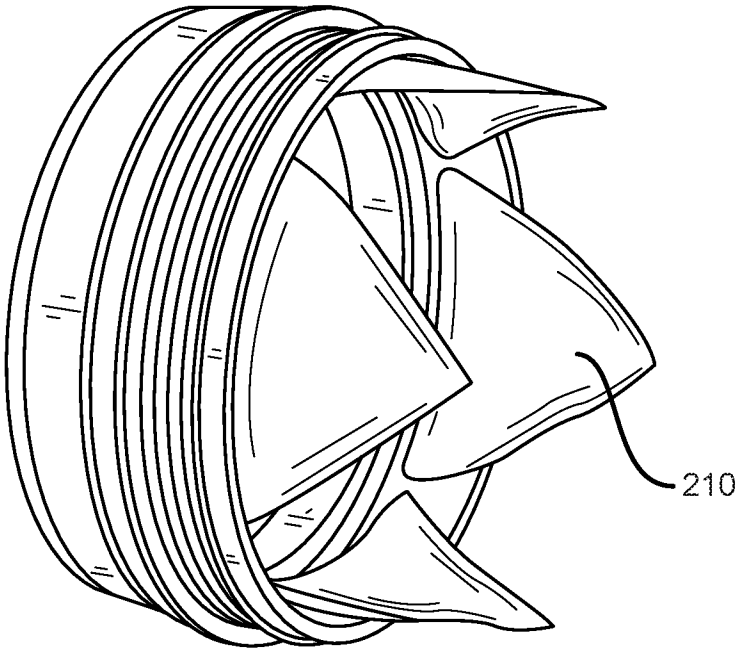
Figure 6:
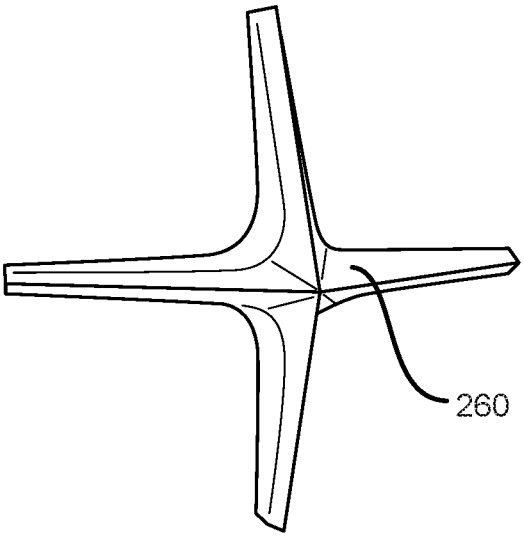
FIG. 6 depicts a broadhead burst disc cutter, in accordance with various embodiments.

According to various embodiments and with reference to FIG. 5A, a non-pierced burst disc assembly 210 is illustrated. According to various embodiments and with reference to FIG. 5B, a pierced and substantially opened burst disc assembly 210 is illustrated. According to various embodiments and with reference to FIG. 6, a single pronged broadhead cutter 260 is depicted. The broadhead cutter 260 may take any form factor. The broadhead cutter 260 is configured for piercing the burst disc assembly 210.

Figure 7:
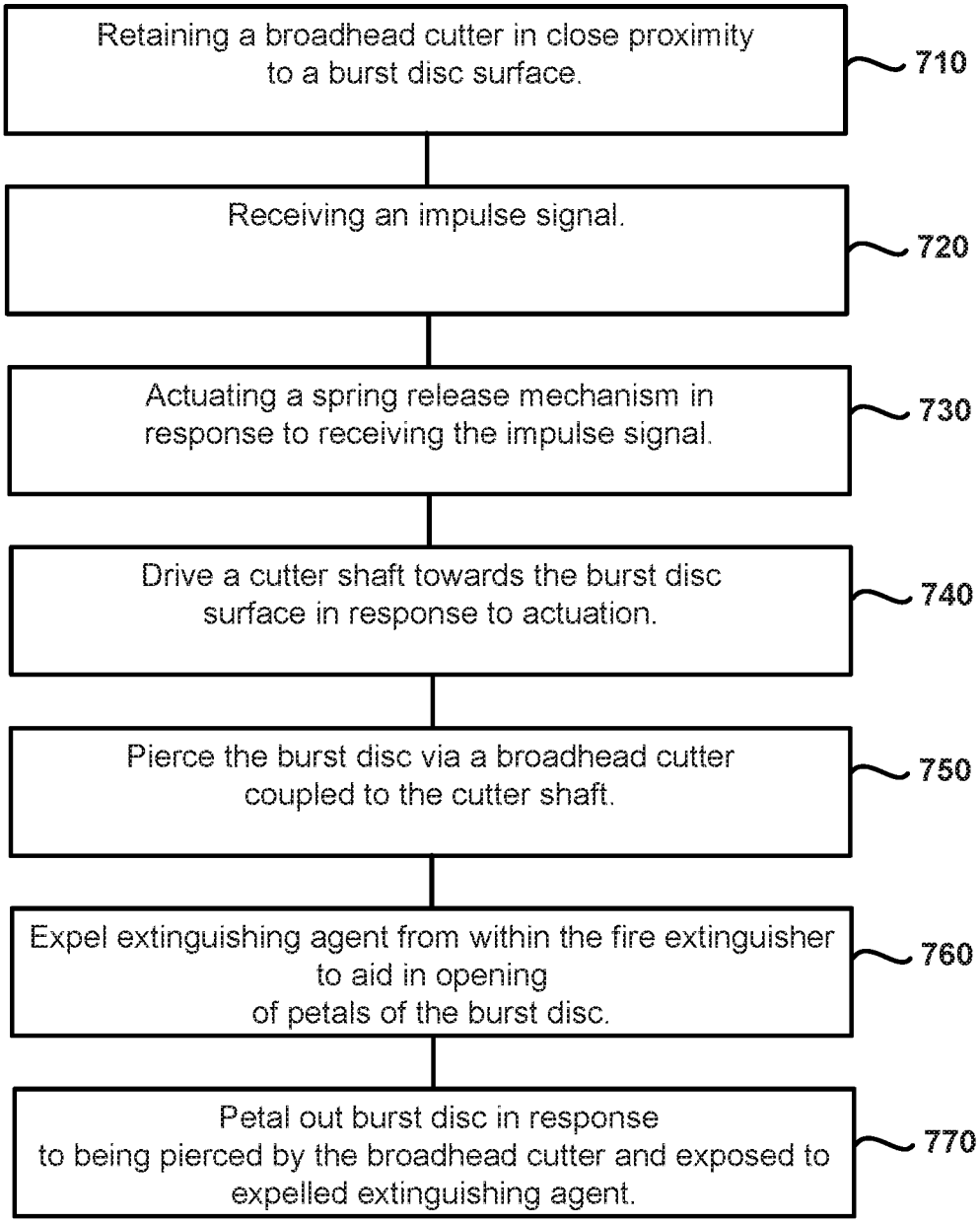
FIG. 7 depicts a method of actuating an advanced fire extinguisher system, in accordance with various embodiments.

According to various embodiments and with reference to FIG. 7, a method of actuating an extinguisher system is illustrated using a flow chart. The method may include retaining a broadhead cutter in close proximity to a burst disc surface (Step 710). The method may include receiving an impulse signal (Step 720). The method may include actuating a spring release mechanism in response to receiving the impulse signal (Step 730). The method may include driving a cutter shaft towards the burst disc surface in response to actuation (Step 740). The method may include piercing the burst disc via a broadhead cutter coupled to the cutter shaft (Step 750). A collet 340 may be configured to retain the spring release mechanism in a standby position. The spring release mechanism may be actuated by an electrical actuation signal. Travel of the cutter shaft 250 may be stopped via physical contact with a stop ring. The pressure and extinguishing agent being expelled from within the fire extinguisher aid in opening of petals of the burst disc assembly 210 (Step 760). The burst disc assembly 210 is configured to petal out in response to being pierced by the broadhead cutter 260 (Step 770).

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more."

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments. Different cross-hatching is used throughout the figures to denote different parts but not necessarily to denote the same or different materials.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A method of actuating an extinguisher system comprising: retaining a broadhead cutter adjacent a burst disc surface; retaining a collet in a standby position via a pull rod, the collet encompassing the pull rod, the pull rod defines a centerline axis; retaining a spring system in a non-actuated position via the collet, wherein an outer flange of the collet is moved outward from the centerline axis to engage a recess within a cutter shaft in response to the spring system being retained in the non-actuated position; receiving an impulse signal; actuating a spring release mechanism in response to receiving the impulse signal, wherein the spring releasing mechanism comprises either a solenoid or a motor, the spring releasing mechanism coupled to the spring system via the pull rod; moving the pull rod with respect to the collet in response to the spring release mechanism actuating, moving the outer flange of the collet inward toward the centerline axis to disengage the recess within the cutter shaft in response to the pull rod moving, driving the cutter shaft towards the burst disc surface, via the spring system, in response to the outer flange of the collet moving inward; and piercing the burst disc surface via the broadhead cutter coupled to the cutter shaft.

2. The method of actuating an extinguisher system of claim 1, wherein the cutter shaft is driven by the spring system.

3. The method of actuating an extinguisher system of claim 1, further comprising stopping travel of the cutter shaft via physical contact with a stop ring.

4. The method of actuating an extinguisher system of claim 1, further comprising expelling extinguishing agent from within a fire extinguisher to aid in opening of the burst disc surface.

5. The method of actuating an extinguisher system of claim 1, wherein the burst disc surface is configured to petal out in response to piercing by the broadhead cutter.

* * * * *